US009708046B1

(12) United States Patent
Araki et al.

(10) Patent No.: US 9,708,046 B1
(45) Date of Patent: Jul. 18, 2017

(54) WATER MUFFLER OF PERSONAL WATERCRAFT

(71) Applicant: Kawasaki Jukogyo Kabushiki Kaisha, Kobe-shi, Hyogo (JP)

(72) Inventors: Toshio Araki, Kakogawa (JP); Kazuma Komura, Himeji (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 0 days.

(21) Appl. No.: 14/983,931

(22) Filed: Dec. 30, 2015

(51) Int. Cl.
*B63H 21/32* (2006.01)
*B63H 21/00* (2006.01)
*B63B 35/73* (2006.01)

(52) U.S. Cl.
CPC ..... *B63H 21/32* (2013.01); *B63B 35/731* (2013.01); *B63H 21/24* (2013.01)

(58) Field of Classification Search
CPC ..... B63H 21/32; B63H 21/38; B63H 21/10; B63H 21/30; F01N 3/04; F01N 13/004; F01N 13/12
USPC ..... 440/89 J, 89 R
See application file for complete search history.

(56) References Cited

U.S. PATENT DOCUMENTS 6,035,633 A * 3/2000 Woods ..... B63H 21/32 440/88 J
6,764,361 B1 * 7/2004 Matsuda ..... B63H 21/32 440/89 B
7,326,093 B2 2/2008 Tsumiyama et al.

* cited by examiner

*Primary Examiner* — Lars A Olson
(74) *Attorney, Agent, or Firm* — Alleman Hall Creasman & Tuttle LLP

(57) ABSTRACT

A water muffler of a personal watercraft comprises: a muffler body; and an inlet pipe which is connected to the muffler body and guides an exhaust gas and cooling water to an inner space of the muffler body. The inlet pipe includes: a center pipe wall; an outer pipe wall provided to surround the center pipe wall; an exhaust passage provided inside the center pipe wall; and a water passage surrounded by the center pipe wall and the outer pipe wall. The center pipe wall has in a downstream end portion of the inlet pipe, a protruding portion protruding from the outer pipe wall in an axial direction of the inlet pipe, and an outlet of the water passage is located to be apart from an outlet of the exhaust passage in an axial direction of the inlet pipe.

3 Claims, 5 Drawing Sheets

Exhaust gas
Exhaust gas
Cooling water
Exhaust gas
Upward
Forward
C41
C31
V
B
C
D
30
31
31a
31c
32
34
36
38
41
42
43
44
45
45a
46
47
48
49
50
51
52
3

WATER MUFFLER OF PERSONAL WATERCRAFT

BACKGROUND OF THE INVENTION

Field of the Invention

The present invention relates to a water muffler incorporated into a personal watercraft.

Description of Related Art

In a personal watercraft, a water muffler is used as an exhaust gas silencer (see U.S. Pat. No. 7,326,093 B2). The water muffler includes an inlet pipe connected to an exhaust pipe extending from an engine. This inlet pipe has a double-walled structure including a center pipe wall, and an outer pipe wall formed to surround the center pipe wall. The inlet pipe is provided with an exhaust passage formed inside the center pipe wall, and a water passage surrounded by the center pipe wall and the outer pipe wall. The downstream end of the inlet pipe is formed with an outlet of the exhaust passage and an outlet of the water passage. The exhaust gas and cooling water flow into the interior of the water muffler through the outlet of the exhaust passage and the outlet of the water passage.

Typically, an exhaust gas outlet and a water outlet are placed to be coplanar with each other. For this reason, the cooling water is highly likely to flow into the exhaust passage through the exhaust gas outlet located inward relative to and close to the water outlet. As a result, the cooling water may flow back toward the engine through the exhaust passage.

SUMMARY OF THE INVENTION

An object of the present invention is to provide a water muffler which can make it difficult for cooling water to flow back through an exhaust passage.

According to an aspect of the present invention, a water muffler of a personal watercraft comprises a muffler body having a tubular shape; and an inlet pipe which is connected to the muffler body and guides an exhaust gas and cooling water to an inner space of the muffler body, wherein the inlet pipe includes: a center pipe wall; an outer pipe wall provided to surround the center pipe wall; an exhaust passage which is provided inside the center pipe wall and through which the exhaust gas flows; and a water passage which is surrounded by an outer peripheral surface of the center pipe wall and an inner peripheral surface of the outer pipe wall, and through which cooling water flows, wherein the center pipe wall has in a downstream end portion of the inlet pipe, a protruding portion protruding from the outer pipe wall in an axial direction of the inlet pipe, and an outlet of the water passage is located to be apart from an outlet of the exhaust passage in the axial direction of the inlet pipe.

In accordance with this configuration, since the outlet of the water passage is located to be apart from the outlet of the exhaust passage in the axial direction of the inlet pipe, the cooling water does not easily reach the outlet of the exhaust passage, after the cooling water has flowed through the water passage and into the inner space of the muffler body. Therefore, the cooling water does not easily flow back through the exhaust passage.

DETAILED DESCRIPTION OF THE PREFERRED EMBODIMENTS

Hereinafter, the embodiment will be described with reference to the drawings. The stated directions are from the perspective of a rider riding on a personal watercraft 1.

Figure 1:
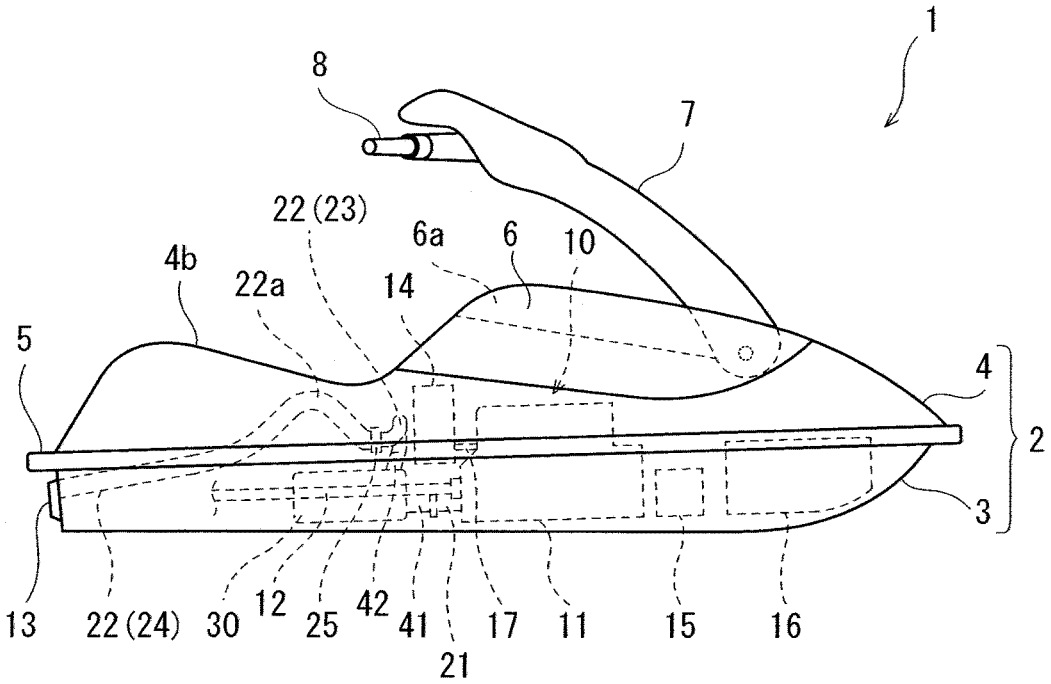
FIG. 1 is a side view of a personal watercraft according to an embodiment.
Figure 2:
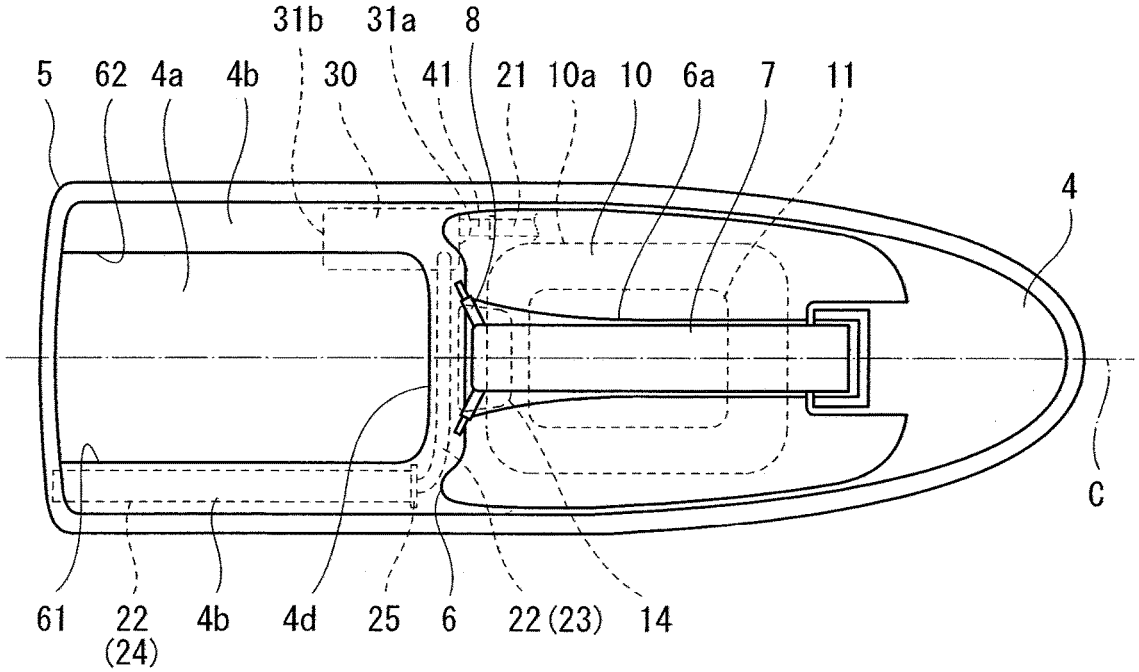
FIG. 2 is a plan view of the personal watercraft.

As shown in FIGS. 1 and 2, the personal watercraft 1 includes a body 2 including a hull 3 and a deck 4. The deck 4 covers the hull 3 from above, and is connected to the hull 3. A connection line of the hull 3 and the deck 4 is in some cases called a gunnel line. An engine room 10 is provided in the interior of the body 2, is in communication with a maintenance opening 10*a* provided in the deck 4, and is opened upward through the maintenance opening 10*a*. An engine hood 6 covers the maintenance opening 10*a* from above, and is detachably attached to the deck 4.

The personal watercraft 1 is a stand-up type personal watercraft which is steered by the rider in a standing posture. A standing deck 4*a*, and right and left deck fins 4*b*, 4*c* are provided at the rear portion of the deck 4. The standing deck 4*a* has a flat floor surface on which the rider stands. The standing deck 4*a* is located rearward relative to the engine room 10. The floor surface of the standing deck 4*a* is set to be lower than the upper end of the engine room 10. The standing deck 4*a* has on the front side thereof, a front wall 4*d* protruding upward and extending in a rightward and leftward direction. The standing deck 4*a* is isolated from the engine room 10 by the front wall 4*d*. The right and left deck fins 4*b*, 4*c* are provided on the right side and the left side of the standing deck 4*a*, respectively, to protrude upward and extend in a forward and rearward direction. The front end portions of the right and left deck fins 4*b*, 4*c* are continuous with the front wall 4*d*. The standing deck 4*a* is surrounded by the right and left standing decks 4*b*, 4*c*, and the front wall 4*d*, which have a U-shape when viewed from above.

The front end portion of a handle pole 7 is coupled to the upper surface of the deck 4 in front of the maintenance opening 10*a* in such a manner that handle pole 7 is rotatable around the front end portion. The handle pole 7 is vertically pivotable around the front end portion thereof. A bar-type steering handle 8 is attached onto the rear end portion of the handle pole 7. A groove 6*a* extending in the forward and rearward direction is provided in the center portion in the rightward and leftward direction of the upper surface of the engine hood 6. The handle pole 7 is accommodated in the groove 6*a* in a state in which the steering handle 8 is not gripped by the rider. The rider stands on the standing deck 4*a*, grips the steering handle 8, and moves the handle pole 7 upward. In this state, the rider steers the personal watercraft 1.

An engine 11 is placed in the engine room 10. The output shaft of the engine 11 is connected to a propeller shaft 12 extending rearward in the interior of the body 2. A water jet pump (not shown) is driven by the propeller shaft 12. The water jet pump pressurizes and accelerates water suctioned through a suction port provided in the hull 3. The pressurized and accelerated water is ejected rearward through a jet nozzle 13 attached to the rear end portion of the body 2. In this way, a forward propulsive force is generated in the body 2.

An air cleaner 14, a battery 15, and a fuel tank 16 are placed in the engine room 10. The air cleaner 14 is connected to the intake port of the engine 11 through an air-intake pipe 17. The battery 15 is configured to store electric power to be supplied to electric components such as a starter motor (not shown) for starting the engine 1, and a controller (not shown) for controlling the engine 11. The fuel tank 16 is configured to store fuel to be supplied to the combustion chamber of the engine 11. The air cleaner 14 is placed rearward relative to the engine 11 and located in the rear portion of the engine room 10. The battery 15 is placed in front of the engine 11. The fuel tank 16 is placed in front of the engine 11 and the battery 15. The fuel tank 11 is located in the front portion of the engine room 10. Further, a part of an exhaust system 20 (see FIG. 3) of the engine 11 is placed in the engine room 10.

Figure 3:
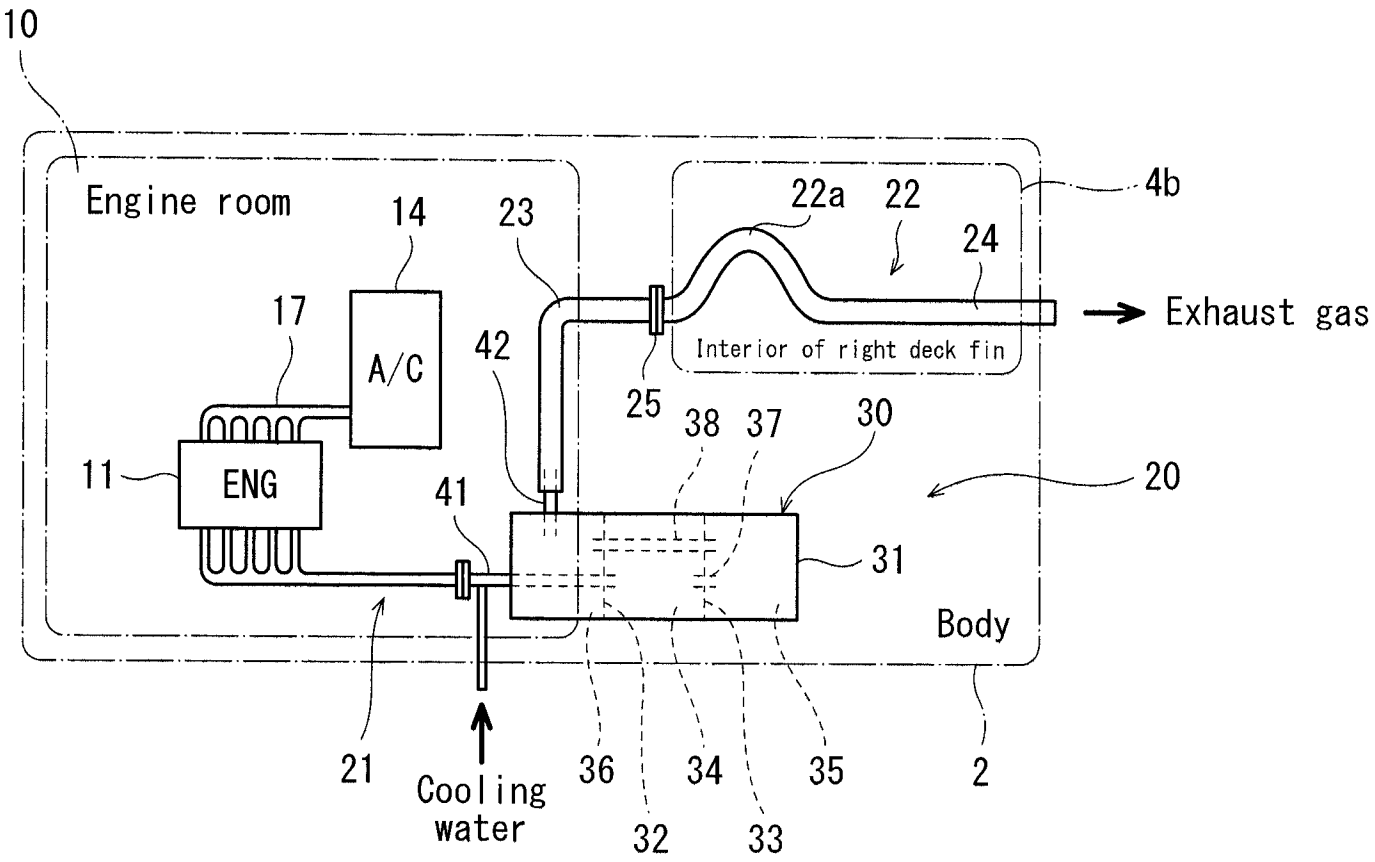
FIG. 3 is a schematic view showing an exhaust system.

As shown in FIG. 3, the exhaust system 20 includes a first exhaust pipe 21, a second exhaust pipe 22, and a water muffler 30. The first exhaust pipe 21 includes one pipe member or a plurality of pipe members which are coupled to each other. The second exhaust pipe 22 has the same structure.

The first exhaust pipe 21 connects the exhaust port of the engine 11 to a water muffler 30 and serves to guide an exhaust gas emitted from the engine 11 to the water muffler 30. The exhaust gas flows through the water muffler 30, and thereby a noise of the exhaust gas is reduced. The second exhaust pipe 22 serves to guide the exhaust gas which has flowed through the water muffler 30 outside of the watercraft. The upstream end of the second exhaust pipe 22 is connected to the water muffler 30, while the downstream end of the second exhaust pipe 22 is opened at the stern. The exhaust gas emitted from the engine 11 flows through the first exhaust pipe 21, the water muffler 30, and the second exhaust pipe 22 in this order, and is discharged outside of the watercraft.

The temperatures of the components included in the exhaust system 20 are elevated by exhaust heat radiated from the engine 11. The exhaust system 20 includes a cooling water passage through which cooling water flows, in addition to an exhaust passage through which the exhaust gas flows. Water surrounding the personal watercraft 1 is used as the cooling water. The temperatures of the components included in the exhaust system 20 and the temperature of the exhaust gas can be lowered by cooling using the water.

The structure of the water muffler 30 will now be described. A muffler body 31 of the water muffler 30 has a cylindrical shape. The muffler body 31 includes a first side wall 31*a* located on a first side (one side) in an axial direction, a second side wall 31*b* located on a second side (the other side) in the axial direction, and a peripheral wall 31*c* connecting the side walls 31*a*, 31*b* to each other, and having a circular cross-section. The muffler body 31 has an inner space surrounded by the walls 31*a* to 31*c*. The muffler body 31 includes a first separating wall 32 and a second separating wall 33 which are placed in an inner space thereof to be spaced apart from each other in the axial direction. The inner space of the muffler body 31 is separated into three chambers 34 to 36 arranged in the axial direction, by the separating walls 32, 33. The first chamber 34 is in communication with the second chamber 35 via a first communicating portion 37. The second chamber 35 is in communication with the third chamber 36 via a second communicating portion 38.

The first chamber 34 is placed between the second chamber 35 and the third chamber 36 in the axial direction and surrounded by the two separating walls 32, 33. The first separating wall 32 and the third chamber 36 are placed on the first side in the axial direction. The second separating wall 33 and the second chamber 35 are placed on the second side in the axial direction. The first communicating portion 37 is constituted by a pipe or a through-hole provided on the second separating wall 33. The second communicating portion 38 is constituted by a pipe penetrating the first separating wall 32 and the second separating wall 33 and extending through the interior of the first chamber 34.

The water muffler 30 includes an inlet pipe 41 and an outlet pipe 42. The upstream end portion of the inlet pipe 41 is connected to the downstream end portion of the first exhaust pipe 21. The downstream end portion of the inlet pipe 41 is opened in the first chamber 34. The upstream end portion of the outlet pipe 42 is opened in the third chamber 36. The downstream end portion of the outlet pipe 42 is connected to the upstream end portion of the second exhaust pipe 22. The exhaust gas emitted from the first exhaust pipe 21 flows through the inlet pipe 41, the first chamber 34, the first communicating portion 37, the second chamber 35, the second communicating portion 38, the third chamber 36, and the outlet pipe 42, and into the second exhaust pipe 22.

The inlet pipe 41 penetrates the first side wall 31*a* and the first separating wall 32 and extends through the interior of the third chamber 36. The inlet pipe 41 protrudes from the first side wall 31*a* in a first direction (one direction) of the axial direction and is connected to the first exhaust pipe 21 in a location that is apart from the muffler body 31 in the first direction of the axial direction. The outlet pipe 42 protrudes radially from the peripheral wall 31*c* and is connected to the second exhaust pipe 22 in a location that is radially apart from the muffler body 31. Since the inlet pipe 41 penetrates the first side wall 31*a* located on the first side in the axial direction and the third chamber 36 is located on the first side in the axial direction, the outlet pipe 42 is close to the inlet pipe 41 in the axial direction. For example, in a case where the water muffler 30 is placed in the interior of the body 2 in such a manner that the axial direction of the water muffler 30 conforms to the forward and rearward direction, the inlet pipe 41 and the outlet pipe 42 are placed in the front portion of the water muffler 30.

Figures 4A, 4B, 4C, 4D:
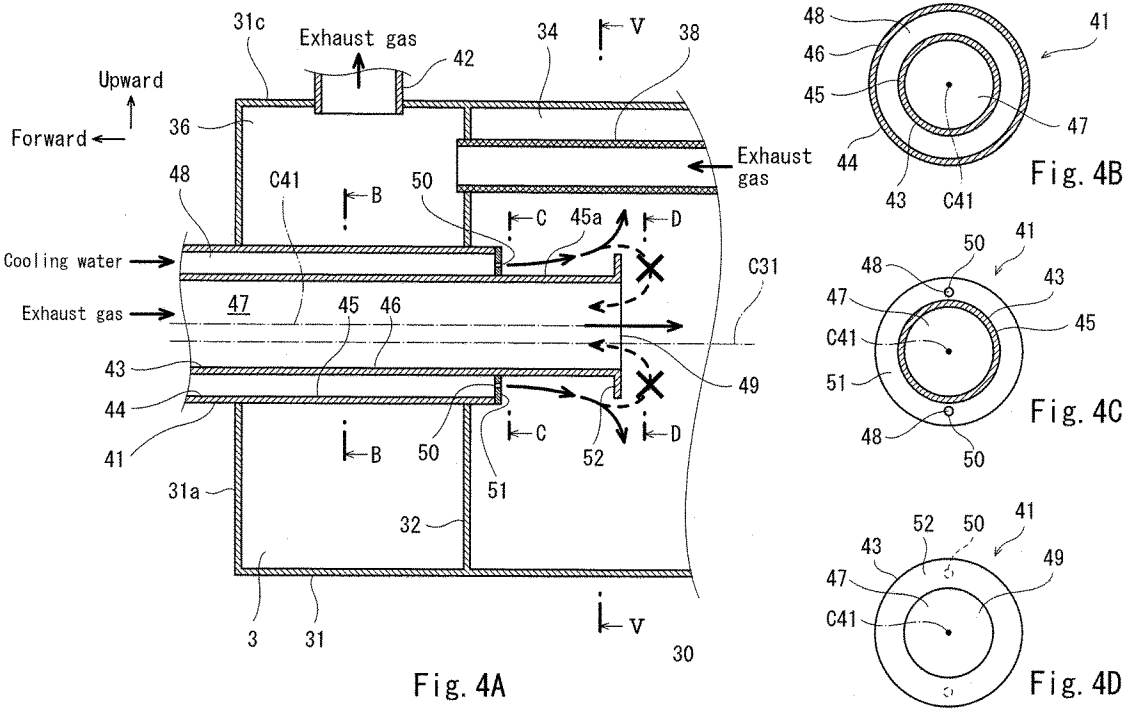
FIG. 4A is a cross-sectional view showing a part of a muffler body and a part of an inlet pipe.
FIG. 4B is a cross-sectional view of the inlet pipe which is taken along line B-B of FIG. 4A.
FIG. 4C is a cross-sectional view of the inlet pipe which is taken along line C-C of FIG. 4A.
FIG. 4D is a view taken in the direction of arrows along line D-D of FIG. 4A (a view showing the downstream end of the inlet pipe when viewed from a first chamber in an axial direction).

As shown in FIG. 4A, the inlet pipe 41 has a double-walled pipe structure. The inlet pipe 41 includes a center pipe 43 and an outer pipe 44. The center pipe 43 has a center pipe wall 45. The outer pipe 44 has an outer pipe wall 46. An exhaust passage 47 through which the exhaust gas flows is provided inside the center pipe wall 45. A water passage 48 through which the cooling water flows is provided between the outer peripheral surface of the center pipe wall 45 and the inner peripheral surface of the outer pipe wall 46. As shown in FIG. 4B, the center pipe 43 and the outer pipe 44 are circular pipes, respectively, and are disposed coaxially with each other. The common axis of the pipes 43, 44 is a center C41 of the inlet pipe 41. The exhaust passage 47 has a circular cross-section. The water passage 48 has a ring-shaped cross-section.

The downstream end portion of the inlet pipe 41 is formed with an outlet 49 (hereinafter referred to as an exhaust gas outlet 49) of the exhaust passage 47, and an outlet 50 (hereinafter referred to as a water outlet 50) of the water passage 48. The downstream end of the center pipe 43 is opened to form the exhaust gas outlet 49. The downstream end of the outer pipe 44 (the downstream end of the water passage 48) is closed by a ring-shaped closing plate 51. The water outlet 50 includes at least one through-hole formed to penetrate the closing plate 51. The through-hole (the water outlet 50) is, for example, a circular hole. In a case where the water outlet 50 includes a plurality of through-holes, the plurality of through-holes are arranged at equal intervals in the circumferential direction of the closing plate 51.

The center pipe wall 45 has a protruding portion 45*a* protruding from the outer pipe wall 46, at a downstream end portion of the inlet pipe 41. In this structure, the water outlet 50 is located to be apart from the exhaust gas outlet 49 in the axial direction of the inlet pipe 41. A distance from the first separating wall 32 to the exhaust gas outlet 49 is set to be longer than a distance from the first separating wall 32 to the water outlet 50. The outer peripheral surface of the center pipe 43 includes an exposed portion which is exposed in the first chamber 34. The ring-shaped closing plate 51 is externally fitted to the center pipe 43. The inner peripheral edge of the closing plate 51 is integrated with the outer peripheral surface of the center pipe 43. The outer surface of the closing plate 51 is exposed in the first chamber 34. The outer surface of the closing plate 51 is made closer to the first separating wall 32 than the downstream end of the center pipe 43 is.

As shown in FIGS. 4A and 4D, the center pipe 43 has a radially protruding portion 52 which radially protrudes, at the downstream end portion thereof. The radially protruding portion 52 is placed to overlap with the water outlet 50 when viewed from the axial direction of the inlet pipe 41.

Figure 5:
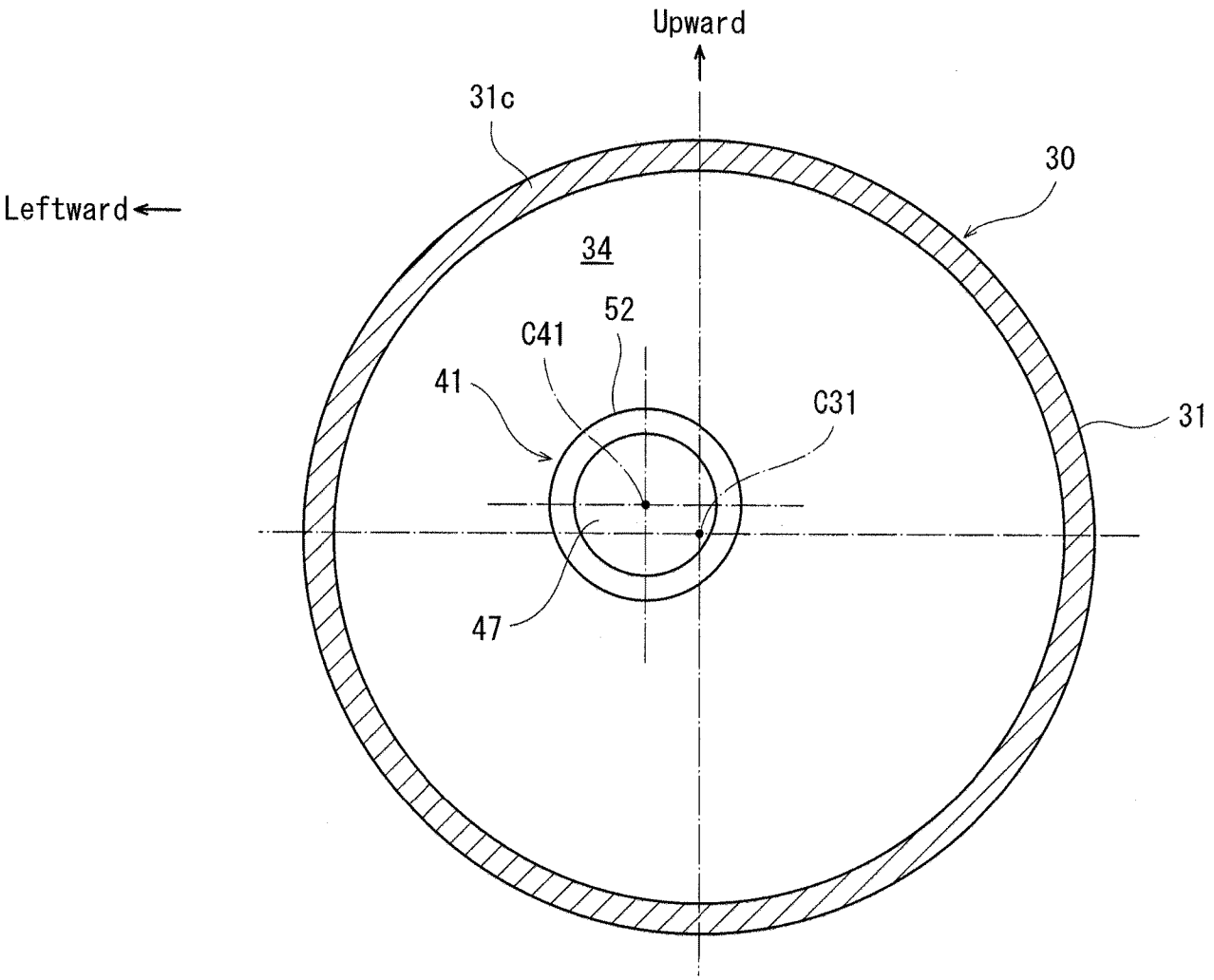
FIG. 5 is a cross-sectional view taken along line V-V of FIG. 4A.

As shown in FIG. 4A, in a state in which the water muffler 30 is incorporated into the body 2, the inlet pipe 41 is inclined downward toward a downstream side. As shown in FIG. 5, the center C41 of the exhaust gas outlet 49 is placed above the center C31 of the muffler body 31. Also, the center C41 of the exhaust gas outlet 49 is apart from the center C31 of the muffler body 31 in the rightward and leftward direction. In the present embodiment, the first exhaust pipe 21 is placed on the left side of the engine 11. In the same manner, the center C41 of the exhaust gas outlet 49 is apart from the center C31 of the muffler body 31, to the left. Alternatively, in a case where the first exhaust pipe 21 is placed at the right side, the center C41 of the exhaust gas outlet 49 may be apart from the center C of the muffler body 31, to the right.

In the water muffler 30 having the above-described configuration, the center pipe wall 45 has the protruding portion 45*a* protruding from the outer pipe wall 46, at the downstream end portion of the inlet pipe 41. The water outlet 50 is placed to be apart from the exhaust gas outlet 49 in the axial direction of the inlet pipe 41. Since the water outlet 50 is placed to be apart from the exhaust gas outlet 49 in the axial direction of the inlet pipe 41, the cooling water does not easily reach the exhaust gas outlet 49 after the cooling water has flowed through the water passage 48 and into the inner space (the first chamber 34) of the muffler body 31 through the water outlet 50. Therefore, the cooling water does not easily flow back through the exhaust passage 47.

In particular, the protruding portion 45*a* is provided with the radially protruding portion 52 which radially protrudes. In this structure, even when the cooling water which has passed through the water outlet 50 flows toward the exhaust gas outlet 49 along the outer peripheral surface of the protruding portion 45*a*, this cooling water can be caused to collide with the radially protruding portion 52. Thus, the cooling water does not reach the exhaust gas outlet 49 and can be diffused in the radial direction of the inlet pipe 41. As a result, the cooling water does not easily flow back through the exhaust passage 47. In the present embodiment, the radially protruding portion 52 overlaps with the water outlet 50 in the axial direction of the inlet pipe 41. The radially protruding portion 52 can suitably prevent the back flow of the cooling water through the exhaust passage 47.

Further, the inlet pipe 41 is inclined downward toward the downstream side. Even if the cooling water flows into the exhaust passage 47, the cooling water can be discharged from the exhaust passage 47 by a gravitational force. This makes it possible to prevent the backflow of the cooling water. The center C41 of the exhaust gas outlet 49 is placed above the center C31 of the muffler body 31. In this structure, even if the cooling water ejected from the water outlet 50 is accumulated in the interior of the water muffler 30, it becomes possible to prevent the back flow of the accumulated cooling water through the exhaust passage 47.

Turning back to FIGS. 1 to 3, the water muffler 30 is placed at the left part of the body 2 with respect to a center line C of the body 2, in a rightward and leftward direction. The first exhaust pipe 21 is placed on the left side of the engine 11 and extends rearward from the engine 11. The water muffler 30 is placed rearward relative to the engine room 10. More specifically, the water muffler 30 is placed to overlap with the left deck fin 4*c* when viewed from above (see FIG. 1). The water muffler 30 is placed below the left deck fin 4*c* and accommodated in the interior of the hull 3 (see FIG. 2). The first side wall 31*a* faces the front, while the second side wall 31*b* faces the rear (see FIGS. 2 and 3). The inlet pipe 41 protrudes forward from the first side wall 31*a* (see FIGS. 2 and 3). The downstream end portion of the first exhaust pipe 21 is connected to the inlet pipe 41 from the front (see FIGS. 2 and 3).

The outlet pipe 42 protrudes upward from a first portion (i.e., front portion) of the water muffler 30 in the axial direction (see FIG. 1). The second exhaust pipe 22 includes a transverse pipe member 23 connected to the water muffler 30, and a downstream pipe member 24 connected to the downstream end portion of the transverse pipe member 23 (see FIGS. 1 to 3). The downstream end portion of the transverse pipe member 23 and the upstream end portion of the downstream pipe member 24 are connected to each other by a flange 25 as a pipe joint (see FIGS. 1 to 3). The outer diameter of the flange 25 is set to be larger than that of the transverse pipe member 23 and that of the downstream pipe member 24.

The transverse pipe member 23 is connected to the downstream end portion of the outlet pipe 42, and extends in the rightward and leftward direction in the interior of the engine room 10 (see FIGS. 1 and 2). More specifically, the transverse pipe member 23 extends in the rightward and leftward direction within a slight clearance in the forward and rearward direction, which is formed between the front wall which isolates the standing deck 4*a* from the engine room 10, and the air cleaner placed rearward relative to the engine 11 in the interior of the engine room 10. The transverse pipe member 23 is made of rubber and has an elasticity. The downstream end portion of the transverse pipe member 23 is connected to the upstream end portion of the downstream pipe member 24 via the flange 25. The downstream pipe member 24 extends rearward and is placed in the interior of the right deck fin 4*b*. The inner spaces of the right and left deck fins 4*b*, 4*c* cannot be accessed easily by a user, but are spatially in communication with the engine room 10. Since the exhaust system 20 includes the transverse pipe member which allows the left part and right part of the body 2 to be in communication with each other, it becomes possible to prevent the backflow of the water toward the engine through the exhaust pipe, even if the personal watercraft 1 is inverted to the left or to the right.

The second exhaust pipe 22 includes a swelling portion 22*a* protruding upward. Because of the presence of the swelling portion 22*a*, it becomes possible to prevent a situation in which the water reaches a portion of the second exhaust pipe 22 which is upstream of the swelling portion 22*a* even when the water outside the watercraft flows forward through the downstream end portion of the second exhaust pipe 22 as backflow. In this way, the water muffler 30 and the engine 11 can be protected.

The swelling portion 22*a* is provided at the downstream pipe member 24. The upstream end portion of the downstream pipe member 24 and the flange 25 are placed below the top portion of the swelling portion 22*a* (see FIG. 1). The upstream portion of the second exhaust pipe 22 has an inverted-U shape.

The swelling portion 22*a* is accommodated in the interior of the right deck fin 4*b*. The upstream end portion of the downstream pipe member 24 is placed in front of the top portion of the swelling portion 22*a*. The upstream end portion of the downstream pipe member 24 and the flange 25 are placed at the front end portion of the right deck fin 4*b* or slightly in front of the front end portion of the right deck fin 4*b*.

Figure 6A:
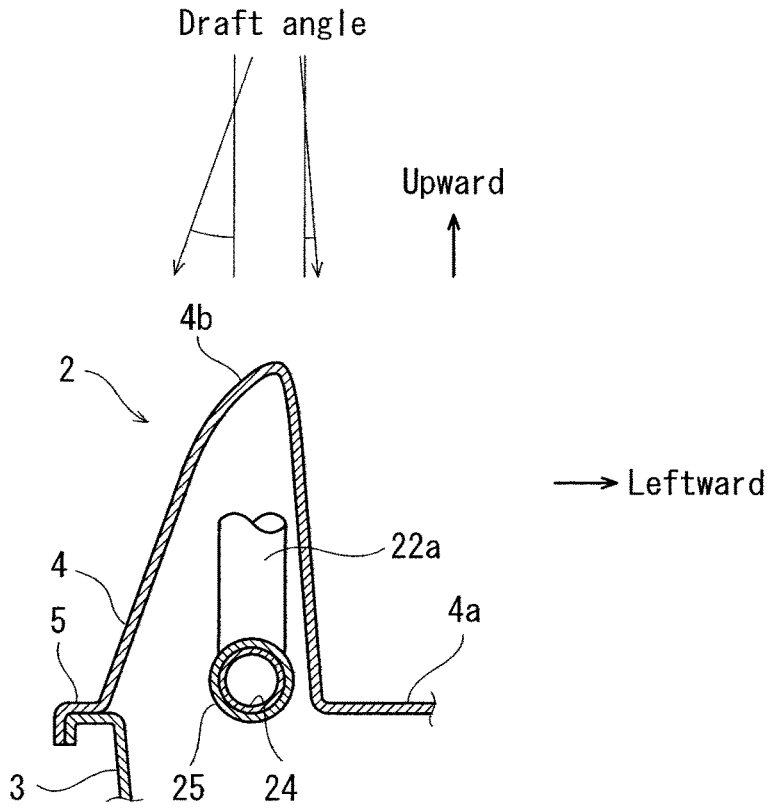
FIG. 6A is a cross-sectional view of a right deck fin, in a region which is in the vicinity of a flange of an exhaust system, when viewed from the front.
Figure 6B:
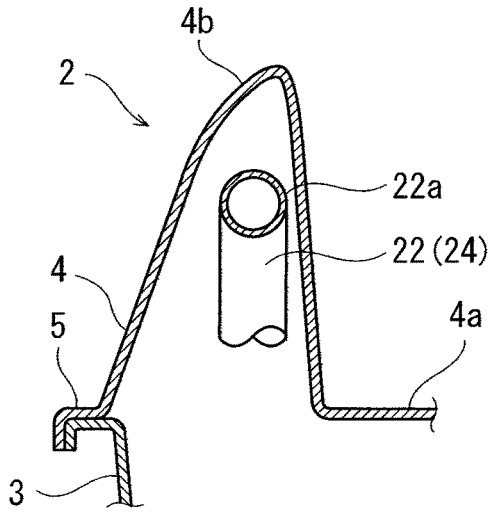
FIG. 6B is a cross-sectional view of the right deck fin, in a region which is in the vicinity of a swelling portion of the exhaust system, when viewed from the front.

FIG. 6A is a cross-sectional view of the right deck fin 4*b*, in a region which is in the vicinity of the flange 25, when viewed from the front. FIG. 6B is a cross-sectional view of the right deck fin 4*b*, in a region which is in the vicinity of the top portion of the swelling portion 22*a*, when viewed from the front. As shown in FIG. 6B, the top portion of the swelling portion 22*a* is close to the inner surface of the top portion of the right deck fin 4*b*. In contrast, the upstream end portion of the downstream pipe member 24 is vertically apart from the inner surface of the top portion of the right deck fin 4*b*. The width of the right deck fin 4*b* is reduced in the rightward and leftward direction as the right deck fin 4*b* extends upward. In a case where the deck 4 is manufactured by molding, the right deck fin 4*b* is designed to have the above-described width, because it is necessary to provide a draft angle.

If the transverse pipe member 23 and the downstream pipe member 24 are connected to each other at the top portion of the swelling portion 22*a*, the top portion of the right deck fin 4*b* is required to have a great lateral width so that the flange 25 can be accommodated therein. Since the right deck fin 4*b* is required to be provided with the draft angle, the lower portion of the right deck fin 4*b* is expanded. This may lead to reduction of the width of the standing deck 4*a*. In the present embodiment, the flange 25 is placed at the lower portion of the right deck fin 4*b*. This makes it possible to reduce the width of the right deck fin 4*b*, and increase the width of the standing deck 4*a*. As a result, the stand-up type personal watercraft 1 which can be steered easily by the rider can be realized.

The water muffler 30 is placed rearward relative to the engine 11 (see FIG. 1). The inlet pipe 41 is provided on the first side wall 31*a* (front wall) of the muffler body 31 so that the inlet pipe 41 can be linearly connected to the first exhaust pipe 21. On the front side of the muffler body 31, the third chamber 36, which is a furthest downstream chamber, of the chambers 34 to 36, is placed (see FIG. 3). For this reason, the outlet pipe 42 is also placed at the front portion of the water muffler 30. Since the outlet pipe 42 is placed at the front portion of the water muffler 30, the upstream portion of the second exhaust pipe 22 is made close to the engine 11. In this layout, the water muffler 30 can be placed below the left deck fin 4*c*, and the upstream portion of the second exhaust pipe 22 can be placed in front of the standing deck 4*a*. Also, the upstream portion of the second exhaust pipe 22 can be placed in the engine room 10. In the rear end portion of the engine room 10, a gap is formed between the separating wall and the air cleaner 14. The transverse pipe member 23 can be extended through this gap. In this way, the transverse pipe member 23 can be placed while avoiding interference with the propeller shaft 12. The transverse pipe member 23 is made of rubber, and is bendable. Therefore, the transverse pipe member 23 can be easily placed in a narrow space. In addition, an operation for connecting the water muffler 30 and the downstream pipe member 24 to each other can be performed easily by use of the transverse pipe member 23.

The above-described configuration and illustration are merely exemplary, and can be changed within the scope of the invention. Although in the example of FIG. 4A, the closing plate 51 is located to be apart from the first separating wall 32 in the axial direction, in the interior of the first chamber, the closing plate 51 may be coplanar with the first separating wall 32. In the example of FIG. 4D, the radially protruding portion 52 protrudes radially from the entire periphery of the protruding portion 45 and has the ring-shape, when viewed from the axial direction of the inlet pipe 41. However, it is sufficient that the radially protruding portion 52 overlaps with the water outlet 50, when viewed from the axial direction of the inlet pipe 41. As shown in FIGS. 4A and 4D, in the case where the plurality of water outlets 50 are arranged to be spaced apart from each other in the circumferential direction, a plurality of radially protruding portions 52 may be provided to protrude from a plurality of locations, respectively, on the outer peripheral surface of the protruding portion 45*a*. The cross-section of each of the muffler body 31 and the inlet pipe 41 need not have a circular shape. The configuration in which the exhaust gas outlet is placed above the center of the muffler body is merely exemplary. Alternatively, the exhaust gas outlet may be placed below the center of the muffler body.

The invention claimed is:

1. A water muffler of a personal watercraft, comprising:

a muffler body having a tubular shape; and an inlet pipe which is connected to the muffler body and guides an exhaust gas and cooling water to an inner space of the muffler body, wherein the inlet pipe includes:

a center pipe wall;

an outer pipe wall provided to surround the center pipe wall;

an exhaust passage which is provided inside the center pipe wall and through which the exhaust gas flows; and a water passage which is surrounded by an outer peripheral surface of the center pipe wall and an inner peripheral surface of the outer pipe wall, and through which cooling water flows, wherein the center pipe wall has in a downstream end portion of the inlet pipe, a protruding portion protruding from the outer pipe wall in an axial direction of the inlet pipe, and an outlet of the water passage is located to be apart from an outlet of the exhaust passage in the axial direction of the inlet pipe, and wherein the protruding portion of the center pipe wall is provided with a radially protruding portion which protrudes in a radial direction of the inlet pipe.

2. A water muffler of a personal watercraft, comprising:

a muffler body having a tubular shape; and an inlet pipe which is connected to the muffler body and guides an exhaust gas and cooling water to an inner space of the muffler body, wherein the inlet pipe includes:

a center pipe wall;

an outer pipe wall provided to surround the center pipe wall;

an exhaust passage which is provided inside the center pipe wall and through which the exhaust gas flows; and a water passage which is surrounded by an outer peripheral surface of the center pipe wall and an inner peripheral surface of the outer pipe wall, and through which cooling water flows, wherein the center pipe wall has in a downstream end portion of the inlet pipe, a protruding portion protruding from the outer pipe wall in an axial direction of the inlet pipe, and an outlet of the water passage is located to be apart from an outlet of the exhaust passage in the axial direction of the inlet pipe, and wherein the inlet pipe is inclined downward toward a downstream side.

3. A water muffler of a personal watercraft, comprising:

a muffler body having a tubular shape; and an inlet pipe which is connected to the muffler body and guides an exhaust gas and cooling water to an inner space of the muffler body, wherein the inlet pipe includes:

a center pipe wall;

an outer pipe wall provided to surround the center pipe wall;

an exhaust passage which is provided inside the center pipe wall and through which the exhaust gas flows; and a water passage which is surrounded by an outer peripheral surface of the center pipe wall and an inner peripheral surface of the outer pipe wall, and through which cooling water flows, wherein the center pipe wall has in a downstream end portion of the inlet pipe, a protruding portion protruding from the outer pipe wall in an axial direction of the inlet pipe, and an outlet of the water passage is located to be apart from an outlet of the exhaust passage in the axial direction of the inlet pipe, and wherein a center of the outlet of the exhaust passage is located above a center of the muffler body.

* * * * *